US009248344B2

(12) United States Patent
Radwan

(10) Patent No.: US 9,248,344 B2
(45) Date of Patent: Feb. 2, 2016

(54) ARM-POWERED SWIMMING AID

(71) Applicant: Adel Radwan, Tom's River, NJ (US)

(72) Inventor: Adel Radwan, Tom's River, NJ (US)

( * ) Notice: Subject to any disclaimer, the term of this patent is extended or adjusted under 35 U.S.C. 154(b) by 0 days.

(21) Appl. No.: 14/136,019

(22) Filed: Dec. 20, 2013

(65) Prior Publication Data

US 2015/0174451 A1 Jun. 25, 2015

(51) Int. Cl.

| | |
|---|---|
| ***A63B 31/10*** | (2006.01) |
| ***B63H 1/36*** | (2006.01) |
| ***B63H 16/18*** | (2006.01) |
| ***A63B 35/02*** | (2006.01) |
| ***B63C 9/11*** | (2006.01) |
| ***B63H 16/08*** | (2006.01) |

(52) U.S. Cl.

CPC ..... *A63B 31/10* (2013.01); *A63B 35/02* (2013.01); *B63C 9/11* (2013.01); *B63H 1/36* (2013.01); *B63H 16/12* (2013.01)

(58) Field of Classification Search

CPC ..... B63H 16/18; B63H 16/20; B63H 16/16; B63H 16/08; B63H 1/36; B63H 1/37; A63B 35/02

USPC ..... 440/14, 15; 441/55–64

See application file for complete search history.

(56) References Cited

U.S. PATENT DOCUMENTS

| | | | | |
|---|---|---|---|---|
| 611,005 | A * | 9/1898 | Stone | 441/56 |
| 3,834,343 | A * | 9/1974 | Hopkins | 440/14 |
| 4,781,637 | A | 11/1988 | Caires | |
| 5,348,503 | A | 9/1994 | Fechtner | |
| 6,375,530 | B1 | 4/2002 | Earl | |
| 6,375,531 | B1 | 4/2002 | Melius | |
| 8,845,372 | B2 * | 9/2014 | Farmer | B63B 35/73 440/102 |
| 8,858,408 | B2 * | 10/2014 | DeMeo | 482/131 |

FOREIGN PATENT DOCUMENTS

JP 61226392 A * 10/1986

* cited by examiner

*Primary Examiner* — S. Joseph Morano
*Assistant Examiner* — Andrew Polay
(74) *Attorney, Agent, or Firm* — Alston & Bird LLP

(57) ABSTRACT

This invention is related to an apparatus and method for swimming by use of a swimming aid comprising an anchoring article and handlebars that are rotated side-to-side by the user. The side-to-side rotation of the handlebars causes a vertical tail fin to move laterally through the water, displacing water, and propelling the user in a forward direction. In a preferred embodiment of the present invention, foldable swim fins are attached to the handlebars. These swim fins can rotate about a horizontal axis such that they displace water when the handlebars are rotated in one direction and rotate horizontally 90 degrees to minimize resistance when the handlebars are rotated in the opposite direction.

5 Claims, 7 Drawing Sheets

ARM-POWERED SWIMMING AID

FIELD OF THE INVENTION

This invention relates to an apparatus and method for aquatic propulsion by rotating handlebars to swing a tail fin along a horizontal axis, thus generating forward thrust to propel a swimmer.

BACKGROUND

Over the years, a variety of designs have been developed that aim to assist a swimmer in aquatic propulsion. However, in comparison to these previous designs, the invention described herein achieves aquatic propulsion generated by the user's upper body motions which power a tail fin. While other systems use energy generated by a user's lower body in order to swing a tail fin to achieve forward propulsion, this invention uses handlebars which, when rotated, swing connecting members from side-to-side, propelling the swimmer forward. In an embodiment of the invention, the handlebars also feature collapsible fins on each handle, wherein when one side of the handlebar is moving forward, the fin on that side folds into a horizontal position to minimize resistance, while the collapsible fin on the other side folds up or down and abuts the handlebar to move water as the handlebar rotates and increase the thrust generated by the apparatus.

Other inventions have also recognized the benefit of using a tail fin to aid in swimming. However, those inventions are easily distinguishable from the present invention.

For example, U.S. Pat. No. 4,781,637 ("the '637 patent") discloses a hydrofoil fin that attaches to a user's feet and propels the swimmer forward using a repetitive up and down undulation with his or her legs. The '637 patent is controlled and powered by a user's lower body muscles and movement, as opposed to the present invention, which is powered by the upper body motions of the user.

Additionally, U.S. Pat. No. 6,375,530 ("the '530 patent") discloses an apparatus designed to flap a tail fin in a vertical manner, similar to a dolphin's tail fin. The apparatus in the '530 patent achieves this motion through the movement of the user's hips in reference to an attached anchoring article. In contrast, in the present invention, the use of a side-to-side moving fin allows the swimmer to move through the water using his upper body by rotating handlebars.

Similarly, U.S. Pat. No. 6,375,531 ("the '531 patent") discloses a dolphin-tail style swim fin that can be powered by holding a separate fin in each hand and moving the fins independently. Unlike the invention of the '531 patent, the present invention uses a fin shaped like the caudal fin of a shark.

Finally, U.S. Pat. No. 5,348,503 ("the '503 patent") discloses a paddle with two blades that the user operates to propel themselves forward, as well as a vertical blade attached to both feet to provide propulsion in cooperation with the arm strokes. The present invention is distinguishable from the '503 patent due to the propulsion being provided solely from movements of the user's upper body. Additionally, in the present invention, the motion of the fin is a side-to-side horizontal motion.

DEFINITIONS

This section provides definitions for some of the terms used in this application. More specifically, the terms "base", "anchoring article", "handlebars", "connecting member", "tail fin", "tail lock", and "swim fins" are defined herein in that order.

As used herein, the "base" 5 refers to a plate and joint unit that is attached to the "anchoring article" 10 (defined below). The base 5 provides an anchoring point for a rotating joint connection 11 with the "handlebars" 1 (defined below). In a preferred embodiment, the base 5 is constructed of carbon fiber or a metal such as aluminum, stainless steel or steel coated to prevent corrosion. In a preferred embodiment wherein the anchoring article 10 is a modified life vest, the base 5 is attached to the anchoring article 10 with screws. See, e.g., FIG. 3. In an alternative embodiment, wherein the base 5 is connected to a surfboard, the base 5 is a flat, preferably metal plate that anchors the rotational joint 11 and is preferably connected to the surfboard with removable straps. Alternatively, the base 5 in said surfboard embodiment comprises a flat hard plastic plate that functions as described previously. The base 5 in this surfboard embodiment can alternatively be affixed to the surfboard more permanently, preferably though screws or water insoluble glue. Alternatively, in a particular surfboard embodiment, the base 5 is located in a recessed area within the surfboard, helping to reduce drag.

As used herein, "anchoring article" 10 refers to an article to which the base is anchored. In some embodiments, the anchoring article 10 is a flotation device of sufficient buoyancy so as to support the user by causing him or her to float at the surface of the water. In other embodiments, the user's own body provides sufficient buoyancy for flotation and the anchoring article 10 is a jacket that is used as an anchoring point for the base, but does not provide sufficient buoyancy to keep the swimmer afloat. In a preferred embodiment, the anchoring article 10 consists of a life vest that extends from about the swimmer's shoulders to about the swimmer's waist, with the base 5 attached to the back of the life vest. In an alternative preferred embodiment, the anchoring article 10 is a floating board such as a surfboard.

As used herein, "handlebars" 1 refers to a mechanism attached to the base using a rotatable joint, which the user can pivot back and forth in a horizontal fashion when holding the bar, which then moves the "tail fin" 8. Most preferably the handlebars 1 comprise one unitary body and are shaped in a V with a handlebar connection that attaches to the rotational joint at the point of the V. In a less preferred embodiment, the handlebars 1 comprise two separate pieces connected at the rotational joint. In another less preferred embodiment, the handlebars have a cross member that extends between both sides of the V about halfway up the length of each side of the V to help provide additional support. In the life vest embodiment, the parts of the handlebars 1 extending out from the point of the V are preferably curved downward so that the handles of the handlebars 1 are at or below the level of the user's head, thus reducing the user's arm strain during operation. In a preferred embodiment, the handlebars 1 are constructed from carbon fiber or a metal such as aluminum, stainless steel, or steel coated to prevent corrosion and have rubber or plastic handle grips attached to the ends to help to prevent the user's hands from slipping during the side-to-side rotation operation.

As used herein, "connecting members" 9 refer to one or more rods that connect the tail fin to the handlebars. In a preferred embodiment these connecting members 9 are of substantially equal length and are made of a flexible material such as 5 mm diameter carbon fiber rods that can be bent into parabolic curves, one in a mirror image of the other. Desirably, the connecting members are anchored at one end to the handlebars 1 and at the other end to a tail fin 8 or tail lock 7.

The combination of the handlebars 1, connecting members 9, and tail fin 8, create a bendable unit that will flex on a horizontal axis, but does not substantially move about a vertical axis. In this preferred embodiment, these connecting members 9 can be repeatedly bent and will return to approximately their original orientation.

In another, even more preferred embodiment the connecting members 9 comprise four rods. Preferably these rods are bent into parabolic curves in groups of two, with each of the two groups of two rods forming substantially a mirror image of the other group. See, e.g., FIG. 2A (showing four rods).

It is further preferred that these connecting members 9 are attached to the handlebars near the rotational joint. A particularly preferred device for connecting the handlebars 1 to the rotational joint 11 is one or more pipe clamps 3.

In an embodiment the handlebars 1, connecting members 9, and tail fin 8 comprise a unitary body and connect to the rotational joint 11 anchored in the base 5.

As used herein, "tail fin" 8 refers to the thin vertical sheet of flexible material with a rigid frame substantially in the shape of a caudal fin of a shark. In a most preferred embodiment about 0.25 inch thick HDPE is used as the tail fin material. Alternatively, neoprene rubber of any of the following thicknesses can be used as the material for the tail fin: about 0.1 inches thick to about 0.5 inches thick. Examples of tail fins 8 are shown in FIGS. 1A, 1B, 2A, 3, and 4. In each figure, the tail fin is labeled "8". In a preferred embodiment, the upper and lower parts of the tail fin are approximately the same size. In a preferred embodiment, the tail fin is constructed from neoprene rubber or plastic such as HDPE.

As used herein, "tail lock" 7 refers to a rigid material attached to the tail fin 8 that serves as an anchoring point for the connecting members 9. The connecting members 9 are mounted onto the tail lock 7 and secured, preferably by means of screws (see, e.g., FIG. 3), rivets, a water-insoluble glue, or velcro, and the tail lock 7 is preferably bolted to the tail fin 8 so that the fin and the connecting members 9 move as a unit. In a preferred embodiment, the tail lock 7 is constructed from carbon fiber or a metal such as stainless steel or steel coated to prevent corrosion or aluminum.

As used herein, "swim fins" 4 and 15 refer to collapsible flaps attached on rotatable joints to the handlebars. Preferably, the rotatable joints comprise thin metal members (e.g., pins) 6 that extend from the fins into holes in the handlebars. See, e.g., FIG. 3, item 6. As one side of the handlebars 1 is moved forward by the swimmer, the resistance of the water causes the swim fin to fold back, settling in a horizontal position as to minimize drag as that side of the handlebar continues to move forward. On the side of the handlebar that is moving backward during this motion, the swim fin will fold into a vertical position, braced by the handlebar itself, which keeps the swim fin from folding completely into a horizontal position in the other direction. As the swim fin is braced in a vertical position up against the handlebar, the swim fin will push water as that side of the handlebar continues to move backwards, thus adding forward thrust. As the handlebars are twisted back and forth, these motions are repeated on either side by the swim fins 4 and 15, reducing resistance on one side and pushing water on the other. In a preferred embodiment, the swim fins 4 and 15 are constructed from about 0.25 inch thick neoprene rubber or about 0.25 inch thick plastic such as HDPE. Alternatively, the swim fins 4 and 15 are constructed from about 0.1 inch thick to about 0.5 inch thick neoprene rubber or about 0.1 inch thick to about 0.5 inch thick plastic such as HDPE.

SUMMARY OF THE INVENTION

The present invention overcomes the drawbacks of existing swimming assistance devices that require a swimmer to use his or her lower body to provide the power for swimming by utilizing a vertically oriented tail fin that is powered by the user's upper body movements. This invention has many practical applications, including providing a swimming aid to those with leg-related disabilities.

The "Arm-Powered Swimming Aid" apparatus of the present invention uses handlebars that cause the "tail fin" to move side-to-side by flexing and moving the connecting members from left to right. This side-to-side movement of the handlebars propels the swimmer forward, aided in some embodiments by additional thrust generated by swim fins that generate additional thrust as the handlebars turn.

These movements allow the user to swim using only his or her upper body to provide the power for propulsion. By turning the handlebars and moving the "tail fin" horizontally, the user can propel himself through the water using upper body movements. While a swimmer can kick or utilize his or her legs to provide greater thrust, the "Arm-Powered Swimming Aid" does not require these additional lower body movements. Additionally, the horizontal motion of the "tail fin" provides greater horizontal maneuverability than vertically moving fins, as well as providing more forward thrust without as much lift or downward force, allowing the swimmer to cruise along the surface of the water, without being bobbed upwards or downwards.

An alternative embodiment of the present invention utilizes the same arm-powered swimming apparatus attached to a surfboard as a different anchoring article. In these other embodiments, the "base" is attached to the bottom of the surfboard, with the connecting members and "tail fin" extending past the rear of the surfboard. In those embodiments, the base is preferably attached to the surfboard using removable straps of nylon, plastic, rubber, or some other suitable material that go around the width of the surfboard. In a preferred embodiment, straps use Velcro® to connect with themselves and fasten the base to the surfboard. Alternatively, in a particular surfboard embodiment, the base is located in a recessed area within the surfboard, helping to reduce drag.

In those embodiments, a swimmer can lie on his stomach on the surfboard and rotate the handlebars to the left and right causing the tail fin to move back and forth horizontally, allowing the user to move along the surface of the water, taking advantage of the greater buoyant force and surface area of the surfboard.

BRIEF DESCRIPTION OF THE FIGURES

FIG. 1B has arrows added to show the side-to-side motion of the apparatus when in operation by a user.

DETAILED DESCRIPTION OF THE PREFERRED EMBODIMENTS

As described with reference to the accompanying figures, the present invention provides an apparatus and method for propelling a user in a forward direction by attaching a mechanism that simulates the movement of a shark tail. The user controls the movement of the tail with his upper body and uses the energy produced from that movement of the tail to propel himself forward.

In a preferred embodiment, the invention is implemented with a life vest as an anchoring article wherein such a life vest is longer than a normal life vest and extends from the user's shoulders to the user's waist. The apparatus of the present invention is attached to the back, or top, of the modified life vest. It is envisioned that the apparatus and method of the present invention can be implemented with any anchoring article a person of ordinary skill in the art would deem suitable. The scope of the present invention is not limited by the type of anchoring article used.

Figure 1A:
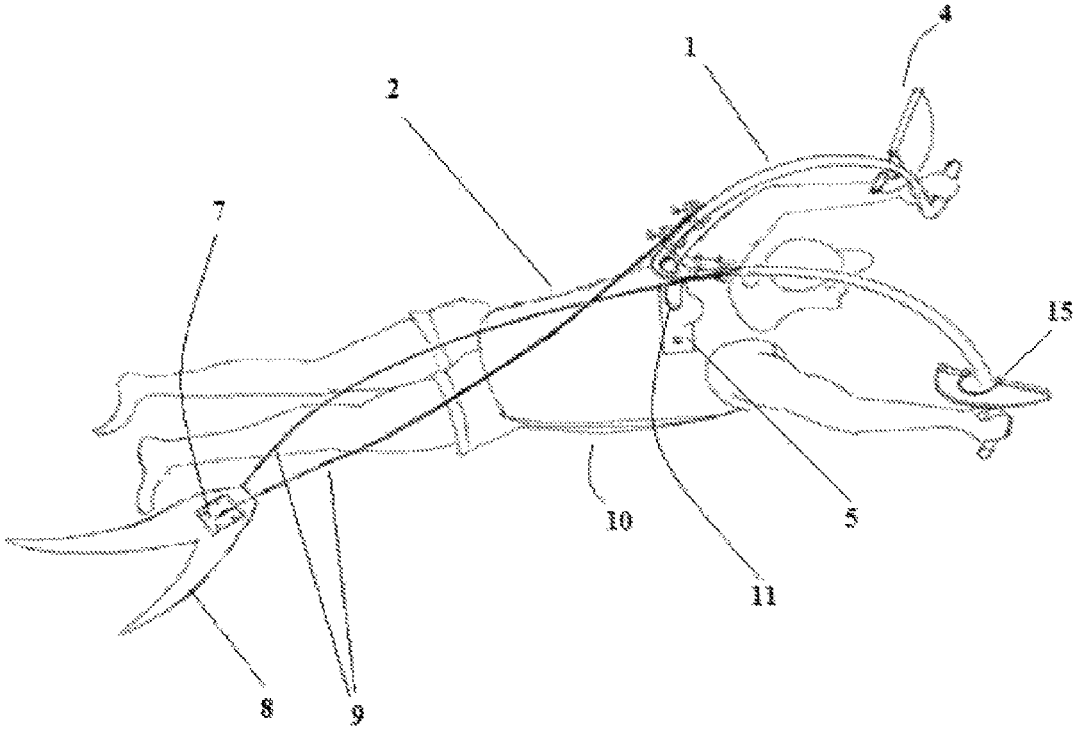
FIG. 1A illustrates the complete Arm-Powered Swimming Aid as worn by a swimmer with the handlebars rotated to the left, or counter-clockwise from a center, neutral position.

FIG. 1A illustrates an embodiment of the present invention implemented with a modified life vest 10. The life vest 10 is modified to be longer than a typical life vest and to extend down to the wearer's waist.

The apparatus of the present invention is configured as follows with reference to FIG. 1A, a preferred embodiment. FIG. 1A shows the complete view of the preferred embodiment as operated by a user 2, with the handlebars rotated to the left, or in the counter-clockwise direction about an axis that is substantially perpendicular to the anchoring article, in this embodiment, a modified life vest. As detailed in FIG. 1A, the apparatus is comprised of handlebars 1 attached to a base 5 by way of a rotational joint 11. The base 5 is attached to a modified life vest 10. The handlebars 1 have the swim fins 4 and 15 attached by pins that extend through the handlebars. The handlebars 1 have two connecting members 9 also attached thereto in this embodiment by pipe clamps. The connecting members 9 extend into and are also anchored to a tail fin 8 by way of an optional tail lock 7. In this embodiment the optional tail lock 7 is bolted to the tail fin 8. In other embodiments the tail fin can be secured to the connecting members in various ways that are evident to a person of ordinary skill in the art.

As explained above, the handlebars 1 are attached to the base through a rotational joint 11. This rotational joint 11 allows for rotational movement of the handlebars 1. It can be seen in FIG. 1A because the handlebars 1 have been rotated to the left, or in the counter-clockwise direction. In FIG. 1A the optional right swim fin 15 has automatically folded into a horizontal position because of the resistance it meets as it moves in the counter-clockwise direction through the water. Likewise, the left swim fin 4 has moved into a vertical position as it is buttressed up against the handlebar 1 due to the resistance of the water as the handlebars 1 move in the counter-clockwise direction. In this figure, the left swim fin 4 helps add to the thrust generated as the left swim fin 4 moves water during the counter-clockwise turning of the handlebars 1.

Figure 1B:
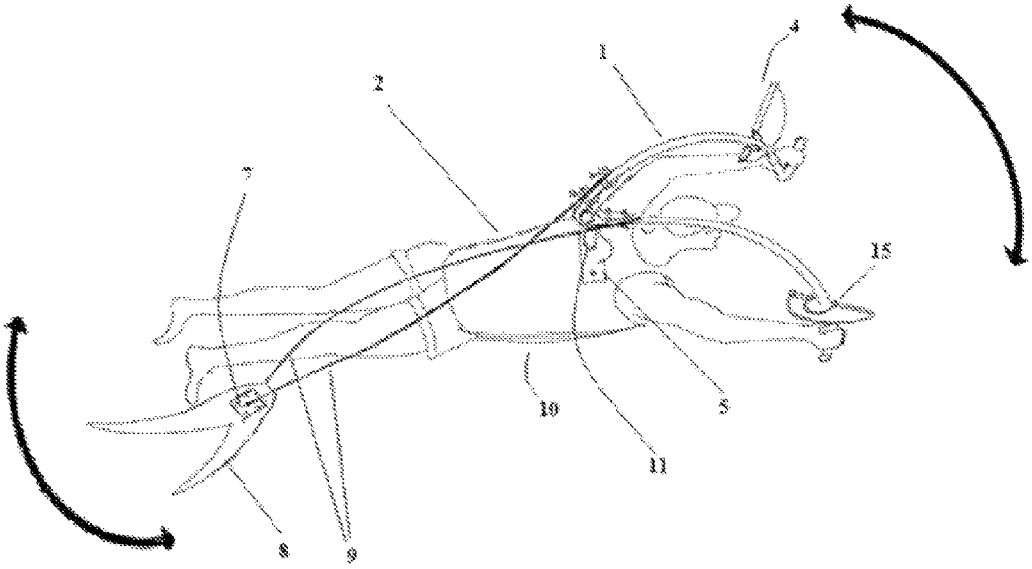
FIG. 1B illustrates the complete Arm-Powered Swimming Aid as worn by a swimmer with the handlebars rotated to the left, or counter-clockwise from a center, neutral position.

FIG. 1B is the same as FIG. 1A except directional arrows have been added in order to indicate the direction of the side-to-side operational movement of the apparatus shown.

Figure 2A:
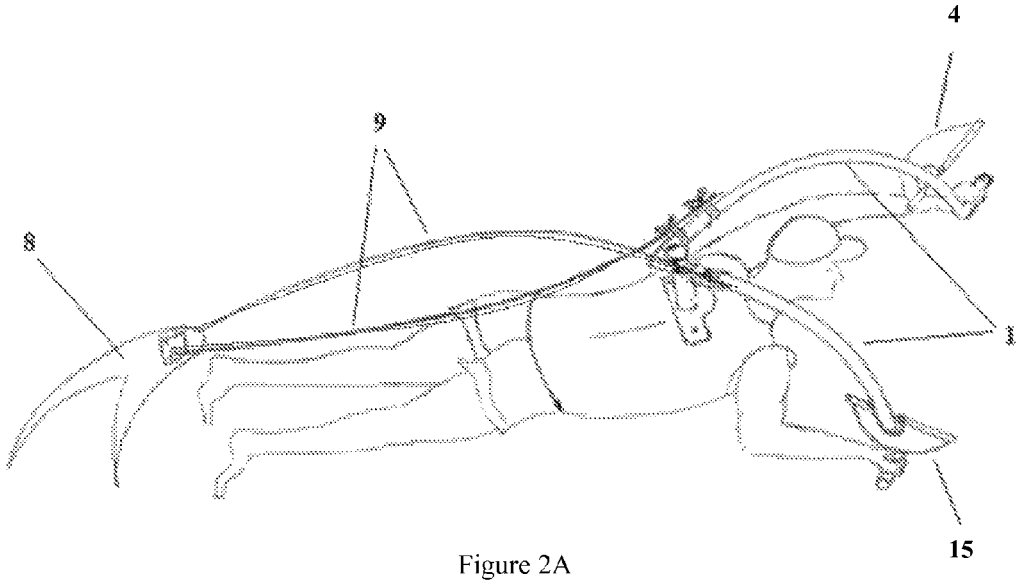
FIG. 2A illustrates the complete Arm-Powered Swimming Aid as worn by a swimmer with the handlebars rotated to the right, or clockwise from a center, neutral position.

FIG. 2A is similar to FIG. 1A and FIG. 1B except that the handlebars 1 have been turned to the right, or in the clockwise direction about an axis that is substantially perpendicular to the anchoring article, here a life vest. It can be seen that the tail fin 8 has moved to the left of the swimmer's body due to the turning of the handlebars 1 to the right (clockwise direction). This movement of the handlebars causes the connecting members 9 to flex and move left (clockwise) in response to the drag caused by the water. The force of the tail fin 8 on the water causes the apparatus to move in the forward direction. It can also be seen in FIG. 2A that the right swim fin 15 has been automatically folded downward into a vertical position, buttressed against the handlebars 1, whereas the left swim fin 4 has automatically folded into a horizontal position to reduce drag. This causes the right swim fin 15 to move additional water and aid in the propulsion forward.

Figure 2B:
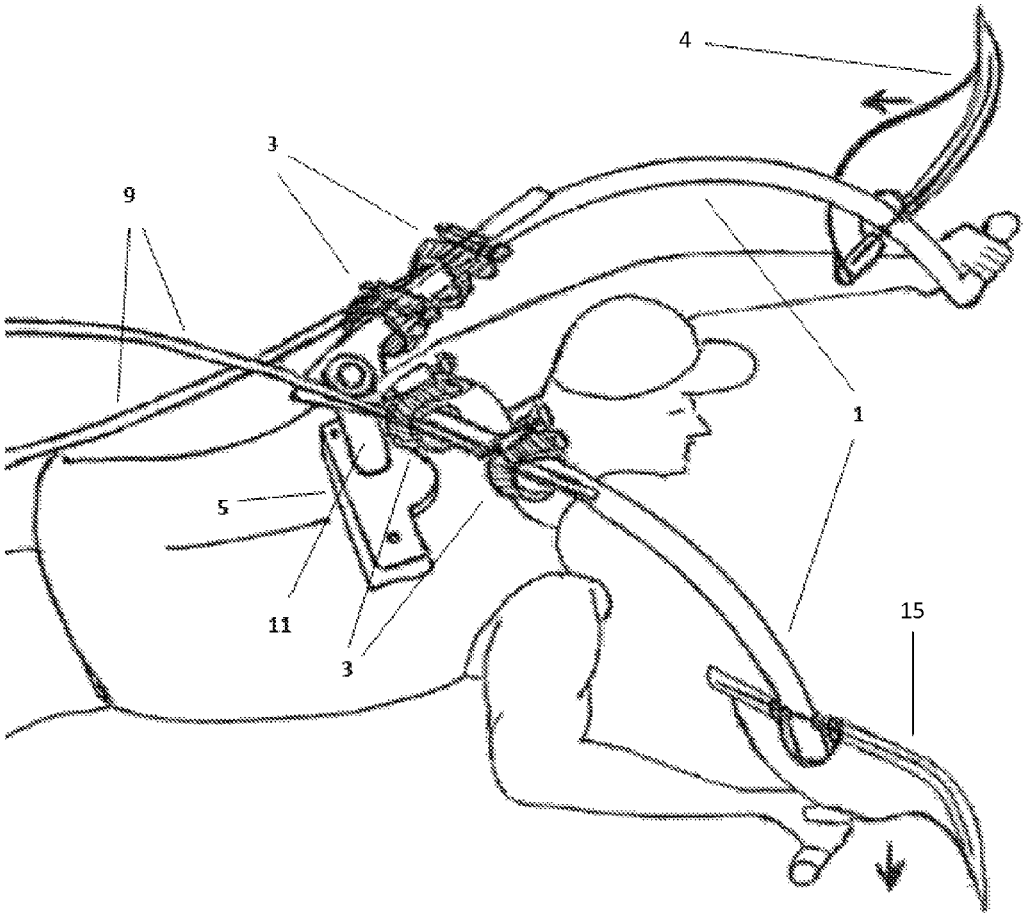
FIG. 2B illustrates a closer view of half of the Arm-Powered Swimming Aid as shown in FIG. 2A with directional arrows showing the positions of the "swim fins".

FIG. 2B is similar to FIG. 2A and includes a close-up view and directional arrows indicating the position of the optional swim fins 4 and 15 in the situation where the user has rotated the handlebars to the right or clockwise from a center, neutral position. As indicated by the arrows, upon rotation to the right, the right hand swim fin 15 moves downward into a vertical position parallel to the arrow shown next to it and is braced by the handlebar while at the same time, the left hand swim fin 4 moves into a horizontal position parallel to the horizontal arrow shown next to it.

Figure 3:
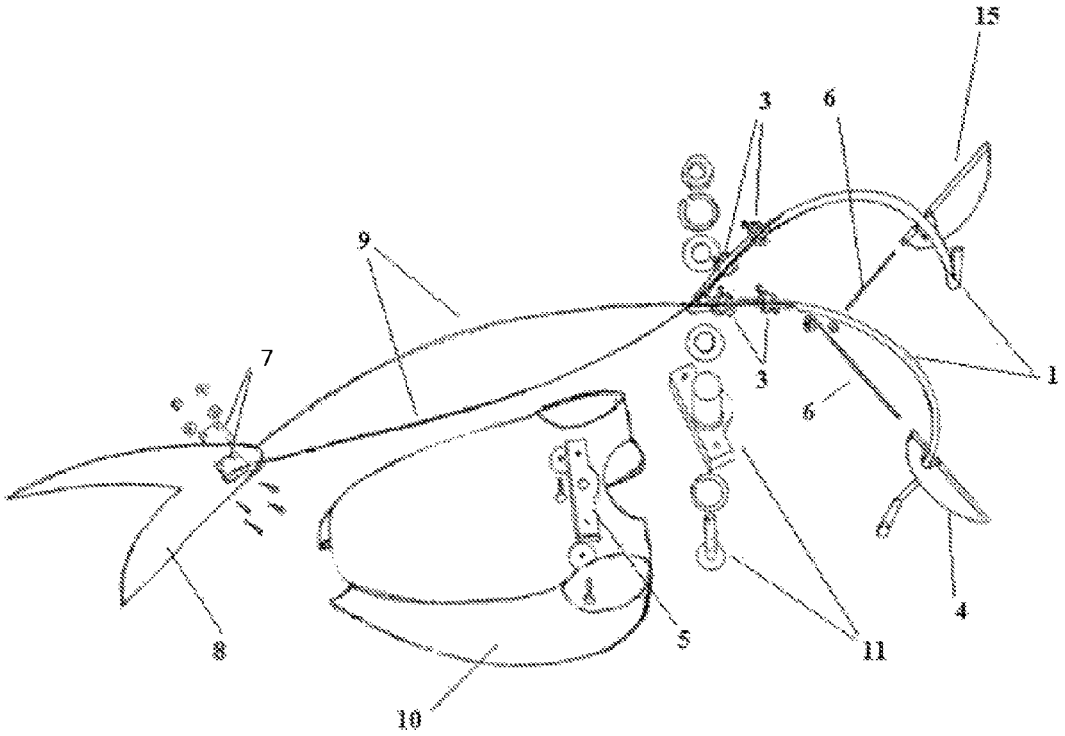
FIG. 3 illustrates an "exploded" view (a drawing that shows the relationship of various parts by slightly separating each component by an equal distance, suspended in surrounding space) of the life vest embodiment of the apparatus without being attached to a swimmer.

FIG. 3 is a more detailed depiction of the apparatus as shown in FIGS. 1A & 1B and 2A & 2B, shown in this figure without the user. The methods of attachment between the components have been exploded, or drawn to show the interconnectivity by slightly separating each article. In this depiction of this embodiment, the base 5 is also bolted onto the life vest 10 with bolts running from inside the vest 10, through the base 5, and into the rotational joint 11. The handlebars 1 are attached to the rotational joint 11, such that the handlebars 1 can freely rotate about a vertical axis. The connecting members 9 run from the tail lock 7 to the handlebars 1, where they run partially up the length of the handlebars and are clamped to them preferably with pipe clamps 3. Additionally, in this embodiment, the tail lock 7, to which the connecting members 9 attach, further comprises two plates on either side of the fin and is attached to the tail fin 8. The two plates comprising the tail lock 7 are bolted to each other by four bolts running through the plates and the tail fin. Finally, it can be seen that the swim fins 4 and 15 are attached to the handlebars 1 by the insertion of pins 6 that run inside each swim fin and through the handlebars, allowing for the swim fins to rotate freely upon a substantially horizontal axis.

Figure 4:
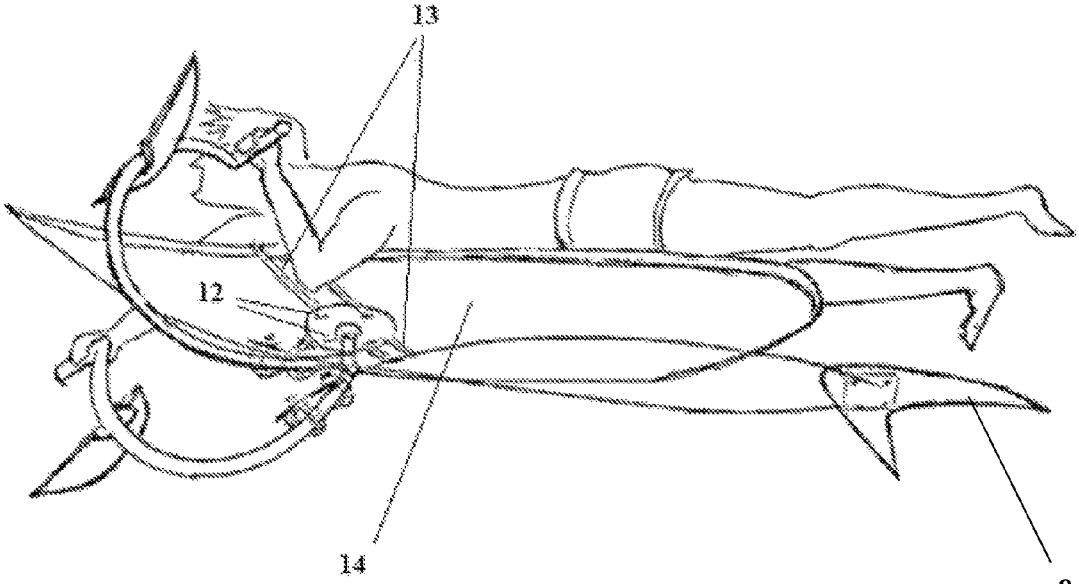
FIG. 4 illustrates an embodiment of the present invention utilizing a surfboard as an anchoring article.

FIG. 4 depicts an alternative embodiment wherein the anchoring article is a surfboard 14. The user lies on top of the surfboard 14, and the base is attached to the bottom of the surfboard by way of straps 13 that wrap around the entirety of the surfboard and run through slots 12 in the base. Like in the above examples, the handlebars are mounted to the base by way of the rotational joint. The apparatus is then the same as that utilized with the alternative embodiments described above, with the handlebars causing the connecting members to sway back and forth horizontally, moving the tail fin and propelling the swimmer forward.

Figure 5:
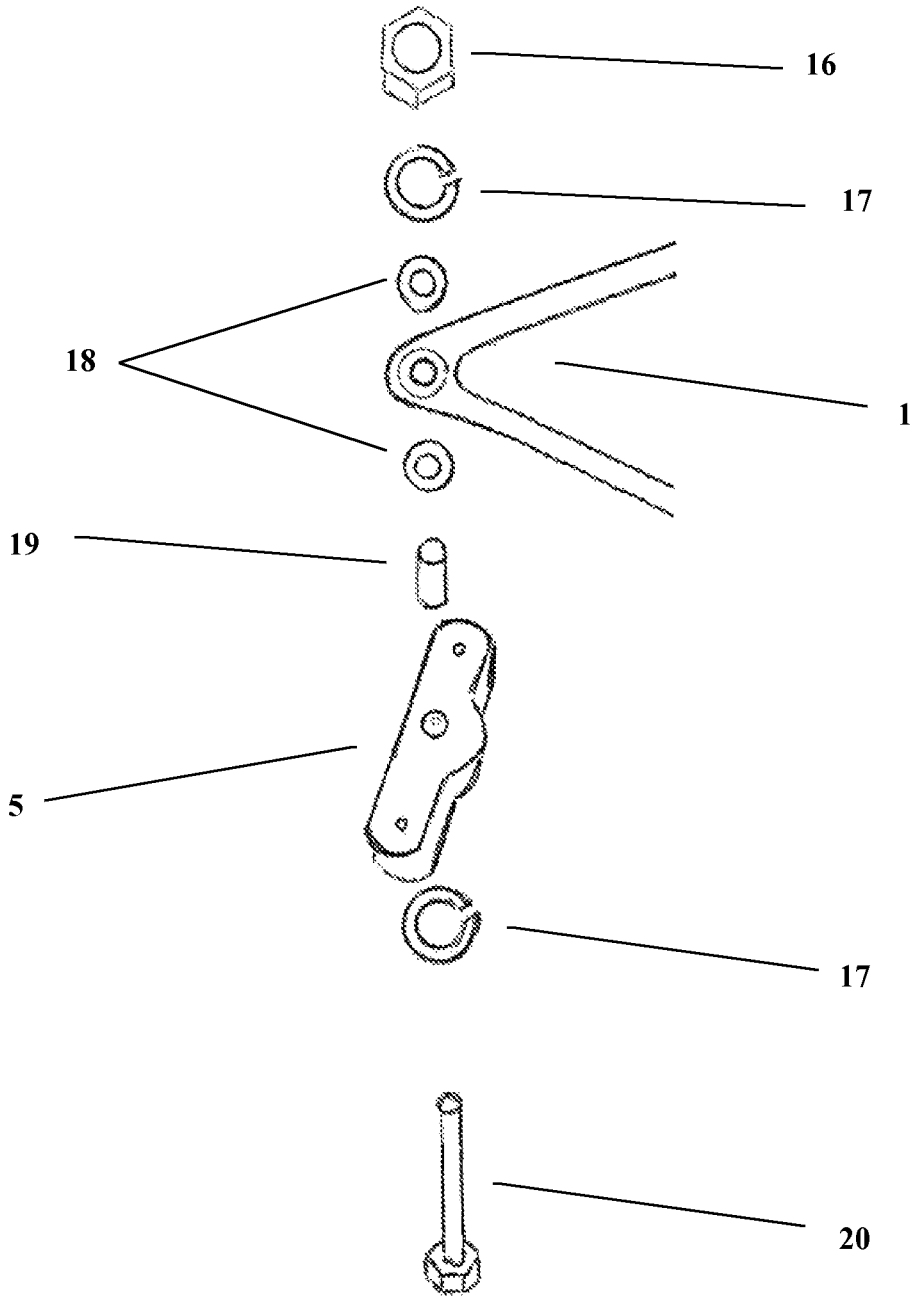
FIG. 5 illustrates an "exploded" view (a drawing that shows the relationship of various parts by slightly separating each component by an equal distance, suspended in surrounding space) of the rotational joint, the base, and the connection point of the handlebars.

FIG. 5 is an exploded view of the components that comprise an embodiment of the rotational joint 11, the base 5, and the connection point of the handlebars 1. In this embodiment, a screw 20 runs through the base 5 and the handlebars 1 and is screwed into a nut 16. More specifically, in this embodiment, a split washer 17 and a flat washer 18 separate the nut 16 from the top of the handlebars 1. In this embodiment, the screw 20 screws through a split washer 17, and continues through the base 5, a metal cylinder 19, a flat washer 18, the hole in the handlebars 1 (partially shown in FIG. 5), another flat washer 18, another split washer 17, and is fastened with a nut 16. These additional components comprise an embodiment of the rotational joint 11 and allow the handlebars to rotate freely while remaining fastened to the base 5.

The description that follows provides an example of the method a swimmer would use to operate the apparatus of the present invention. For illustration purposes, reference is made to FIGS. 1A and 1B.

To operate the embodiment illustrated in FIG. 1A, the swimmer 2 secures the life-vest 10 around his body and grips the handlebars 1 with his hands. In an alternative embodiment shown in FIG. 4, the swimmer lies on top of surfboard on his stomach and grips the handlebars with his hands. The swimmer then pulls one side of the handlebars towards his body, while simultaneously pushing the other side of the handlebars away from his body. This in turn will cause the connecting members 9 to move to one side, with the connecting members flexing in response to the resistance of the water, causing the tail fin 8 to displace water and propel the user forward. See FIG. 1B (with directional arrows showing the side-to-side movement of the apparatus when in use). The user then reverses the direction of the handlebars by pulling the handle that is farther away from his body towards his body while simultaneously pushing the handle that was closer to his body away from his body. This motion will cause the connecting members and the tail fin to move in the opposite direction and displace water to the other side. The swimmer then repeats this above stated process of rotating the handlebars back and forth to continue moving forward through a fluid.

What is claimed is:

1. An arm-powered swimming apparatus comprising:

a. an anchoring article comprising a longitudinal axis in a horizontal plane;

b. a base affixed to said anchoring article;

c. a horizontally rotatable joint with an axis of rotation perpendicular to the horizontal plane mounted on said base;

d. handlebars with a handle at each end attached to said rotatable joint;

e. a first end of each of at least two connecting members attached to said handlebars; and f. a tail fin attached to a second end of said connecting members;

wherein rotation of said handlebars about an axis substantially perpendicular to said longitudinal axis of said anchoring article causes said tail fin to move laterally.

2. The apparatus of claim 1 further comprising a tail lock that connects said connecting member to said tail fin.

3. The apparatus of claim 1 wherein said anchoring article comprises a life vest that has been modified such that it extends in length to a user's waist.

4. The apparatus of claim 1 wherein said anchoring article comprises a surfboard.

5. The apparatus of claim 1 in which said handlebars further comprise rotatable swim fins.

* * * * *